US008662476B2

(12) United States Patent
Weddle

(10) Patent No.: US 8,662,476 B2
(45) Date of Patent: Mar. 4, 2014

(54) POST RAM

(75) Inventor: David R. Weddle, Bunker Hill, WV (US)

(73) Assignee: Weddle Tool Company, Bunker Hill, WV (US)

( * ) Notice: Subject to any disclaimer, the term of this patent is extended or adjusted under 35 U.S.C. 154(b) by 359 days.

(21) Appl. No.: 12/929,536

(22) Filed: Jan. 31, 2011

(65) Prior Publication Data

US 2012/0193593 A1 Aug. 2, 2012

(51) Int. Cl.
*B66F 7/04* (2006.01)

(52) U.S. Cl.
USPC ..... 254/93 H; 254/93 R; 254/89 H; 254/2 B

(58) Field of Classification Search
USPC ..... 254/93 H, 93 R, 89 H, 2 B, 7 B
See application file for complete search history.

(56) References Cited

U.S. PATENT DOCUMENTS

| | | | | |
|---|---|---|---|---|
| 685,011 | A | 10/1901 | Tell | |
| 3,773,292 | A | 11/1973 | Thiermann | |
| 3,851,856 | A | 12/1974 | Berg | |
| 3,902,699 | A | 9/1975 | Brackett | |
| 3,959,970 | A * | 6/1976 | Bos et al. | 60/477 |
| 5,499,890 | A | 3/1996 | Kishi | |
| 6,027,102 | A * | 2/2000 | Krupa | 254/93 R |
| 6,145,813 | A * | 11/2000 | Anderson | 254/418 |
| 6,234,451 | B1 * | 5/2001 | Baron | 254/122 |
| 6,637,908 | B1 * | 10/2003 | Hung | 362/109 |
| 6,746,183 | B1 | 6/2004 | Sullivan | |
| 7,490,813 | B1 | 2/2009 | Weddle | |
| 7,798,464 | B2 * | 9/2010 | Brewer, III | 248/638 |
| 8,201,807 | B2 * | 6/2012 | Hernandez, Jr. | 254/93 H |
| 2012/0193593 | A1 * | 8/2012 | Weddle | 254/93 H |

* cited by examiner

*Primary Examiner* — Lee D Wilson
(74) *Attorney, Agent, or Firm* — Capitol City TechLaw

(57) ABSTRACT

A post ram is disclosed herein. The post ram includes a socket member that is configured to receive one end of a wooden post. A thumbscrew threadably engages, and penetrates, the socket member for selectively securing the wooden post within the socket member. A bottle jack is affixed atop the socket member.

12 Claims, 3 Drawing Sheets

POST RAM

FIELD OF THE INVENTION

The present invention relates generally to implements for applying pushing or pulling force utilizing fluid pressure.

BACKGROUND OF THE INVENTION

During reconstruction projects, carpenters frequently substitute temporary supports for load-bearing walls to keep buildings sound. When the walls are rebuilt or replaced by other structures, the supports are removed and set aside for reuse thereby minimizing waste and reducing costs.

An adjustable column is a common type of temporary support. Such a column includes a rigid, metallic tube having a load-bearing plate affixed to one of its ends and a threaded rod screwed into the other one of its ends. Usually, a second, load-bearing plate is affixed to the free end of the threaded rod. By turning the rod with a wrench, the length of an adjustable column can be varied for a custom fit between a floor and a ceiling.

Adjustable columns have drawbacks. First, the metallic tube of an adjustable column is hollow and can bend if it is not properly placed. Second, the metallic tube cannot be easily cut to fit within an extremely short span. Also, when the weight of a structure is placed on an adjustable column, stresses within the threaded rod can exceed design limits resulting in structural failures. Additionally, many users do not provide footings of sufficient size and strength beneath adjustable columns. Many users simply place the column on a wood or concrete floor thereby causing the floor to crack. Finally, adjustable columns are not capable of operating without the use of additional tools. If a user lacks an appropriate wrench, or is unable to turn the threaded rod with a wrench in a tight spot, an adjustable column cannot be utilized.

SUMMARY OF THE INVENTION

In light of the problems associated with adjustable columns, it is a principal object of my invention to provide a temporary support for a building structure that is exceptionally strong, unlikely to deform under expected loads, and can be easily sized to fit into spaces having high or low ceilings. My support can be used in construction and remodeling projects, large and small. If needed, my support can be used to correct sagging floors by propping up basement, porch, or deck beams and can take the weight of large appliances positioned on the sagging floors. Alternately, my support can be used to level and support recreational vehicles or manufactured homes.

It is a further object of the invention to provide a temporary support of the type described that is easy to install, has no loose parts, and requires no additional tools to use.

It is another object of the invention to provide a temporary support of the type described that utilizes a conventional wooden post of square cross section in its construction. Prior to use, the post may be custom cut to any desired length.

Still another object of the invention is to provide a temporary support of the type described that features a post ram—a bottle jack affixed atop a socket member that is adapted to snugly receive one end of a wooden post therein. During use, the bottle jack is manually pumped to selectively lengthen the temporary support thereby snugly fitting the temporary support into the gap that it is intended to span.

It is another object of my invention to provide a post ram featuring a load-bearing plate that can be attached by penetrating fasteners to a wooden member like a stud or joist.

It is an object of the invention to provide improved features and arrangements thereof in a post ram for the purposes described which is portable, lightweight in construction, inexpensive to manufacture, and dependable in use.

The foregoing and other objects, features, and advantages of my temporary support and post ram will become readily apparent upon reviewing the following detailed description and accompanying drawings.

BRIEF DESCRIPTION OF THE DRAWINGS

My invention can be more readily described and understood with reference to the accompanying drawings, in which.

Similar reference characters denote corresponding features consistently throughout the accompanying drawings.

DETAILED DESCRIPTION OF THE PREFERRED EMBODIMENT

Figure 1:
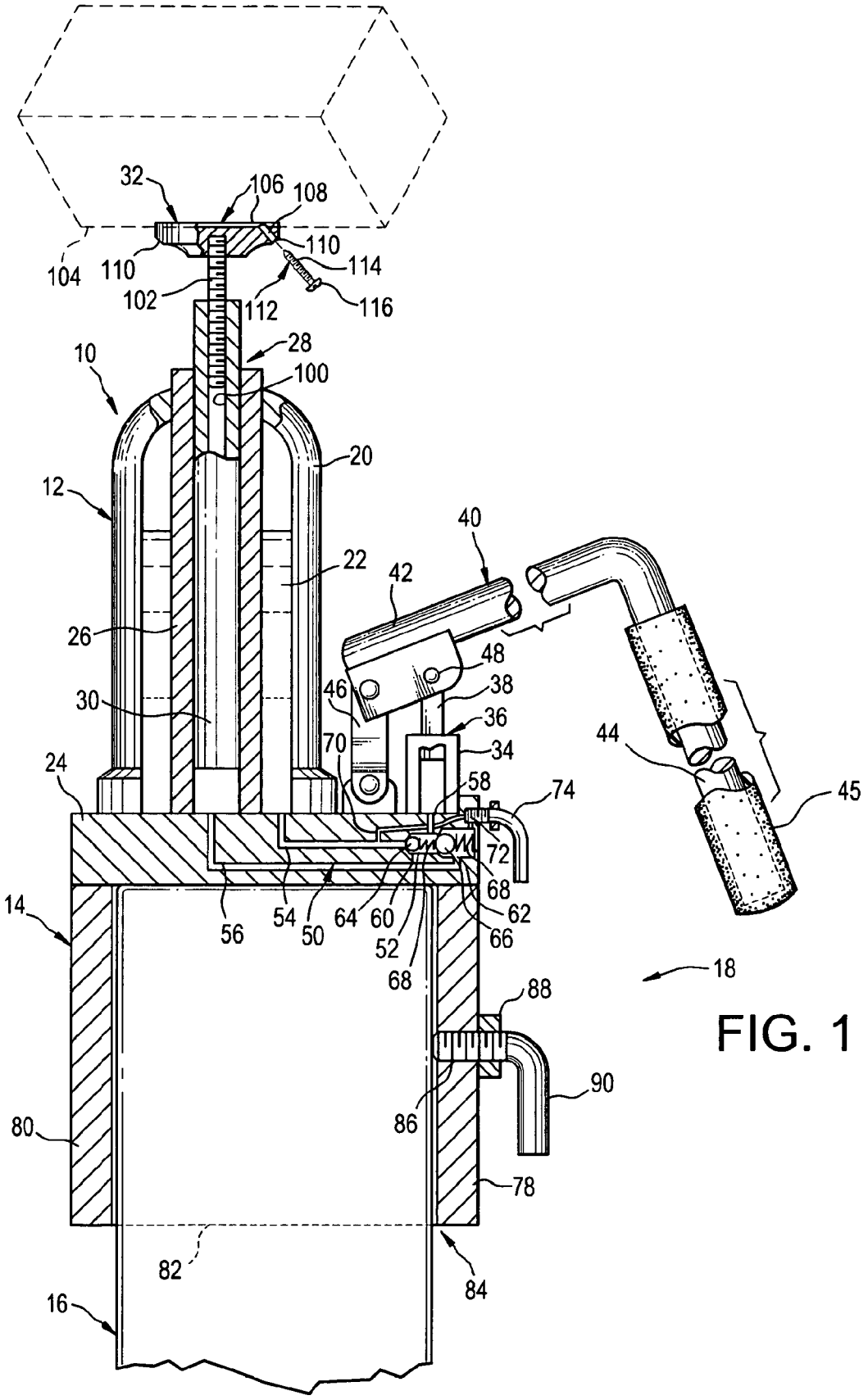
FIG. 1 is a side elevational view of a temporary support in accordance with the present invention with portions broken away to reveal details thereof. The temporary support has a post ram fitted atop a wooden post.
Figure 2:
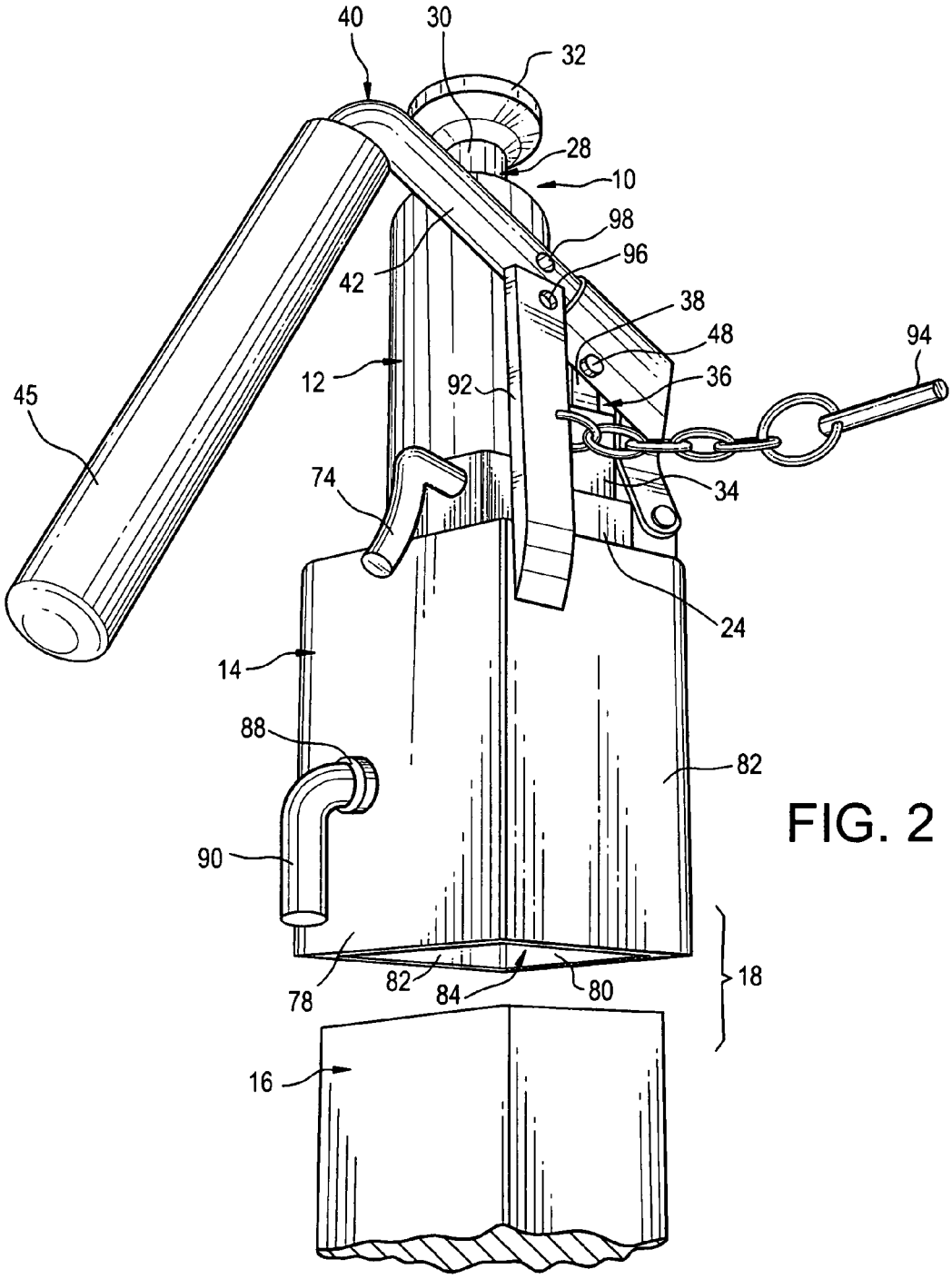
FIG. 2 is a perspective view of the temporary support with portions of the wooden post being broken away.

Referring now to the FIGS., a post ram in accordance with the present invention is shown at 10. The post ram 10 includes a bottle jack 12 affixed atop a socket member 14. The socket member 14 is sized to snugly receive one end of a wooden post 16 therein. When joined together, the post ram 10 and post 16 define a temporary support 18 that is useful in a variety of settings.

The bottle jack 12 includes a reservoir 20, containing a measured quantity of hydraulic oil 22 affixed atop a base plate 24. A main cylinder 26 is affixed within the reservoir 20 and has an opening 28 located at the top of the reservoir 20. A main piston 30 is slidably positioned within the main cylinder 26 and can be selectively extended from the opening 28. A wide, load-bearing plate 32 is affixed to the free end of the main piston 30 outside the main cylinder 26.

A pump cylinder 34 is affixed atop the base plate 24 adjacent the reservoir 20. The pump cylinder 34 has an open top 36. A pump piston 38 is slidably positioned within the pump cylinder 34 and can be selectively extended from the open top 36.

An L-shaped lever arm 40 is utilized to reciprocate the pump piston 38. The lever arm 40 has an inner segment 42 that is joined to an outer segment 44 at a right angle. While the post ram 10 is being stored prior to use, the inner segment 42 is normally disposed in a horizontal position parallel to the base plate 24. Simultaneously, the outer segment 44 is oriented in a vertical position, extending downward from the inner segment 42 adjacent to the socket member 14. A rubber handgrip 45 is disposed on the outer segment 44 to facilitate a good grip on the lever arm 40 by the hand of a user.

The inner segment 42 of the lever arm 40 is pivotally connected, by means of a hinged link 46, to the base plate 24 adjacent the pump cylinder 34. A pivot pin 48, positioned between the link 46 and the junction of the inner segment 42 and outer segment 44, connects the lever arm 40 to the top of the pump piston 38. By moving the free end of the lever arm 40 up and down, the pump piston 38 is reciprocated within the pump cylinder 34 with a mechanical advantage.

A pump passageway 50 within the base plate 24 places the reservoir 20, the main cylinder 26, and the pump cylinder 34 in fluid communication with one another. The pump passageway 50 has four principal parts: a valve segment 52, a reservoir segment 54 that connects the valve segment 52 to the reservoir 20, a main cylinder segment 56 that connects the valve segment 52 to the main cylinder 26, and a pump cylinder segment 58 that connects the valve segment 52 to the pump cylinder 34.

The valve segment 52 of the pump passageway 50 has a small-diameter chamber 60 and a large-diameter chamber 62 connected side-by-side. As shown, a small-diameter ball 64 is positioned within the small-diameter chamber 60 and a large-diameter ball 66 is positioned in the large-diameter chamber 62. The small-diameter ball 64 and the large-diameter ball 66 are free to move within their associated chambers 60 and 62. The large-diameter ball 66 is larger in diameter than the small-diameter chamber 60 and cannot enter the small-diameter chamber 60. A pair of compressed springs 68 presses the balls 64 and 66 into sealing engagement with the ends of the chambers 60 and 62.

The reservoir segment 54 of the pump passageway 50 extends from the bottom of the reservoir 20 to the small-diameter chamber 60. Since the reservoir segment 54 has a diameter that is less than that of the small-diameter ball 64, the ball 64 is effectively trapped within the small-diameter chamber 60 and cannot pass into the reservoir segment 54.

The main cylinder segment 56 of the pump passageway 50 extends from the large-diameter chamber 62 to the bottom of the main cylinder 26. Since the main cylinder segment 56 has a diameter that is less than that of the large-diameter ball 66, the ball 66 is effectively trapped within the large-diameter chamber 62 and cannot pass into the main cylinder segment 56.

The pump cylinder segment 58 of the pump passageway 50 extends from the small-diameter chamber 60 to the bottom of the pump cylinder 34. More specifically, the pump cylinder segment 58 branches from the small-diameter chamber 60 at a point about midway between the connections with the reservoir segment 54 and the large-diameter chamber 62 to the small-diameter chamber 60. Since the pump cylinder segment 58 has a diameter that is less than that of the small-diameter ball 64, the ball 64 cannot pass into the pump cylinder segment 58.

A pressure release passageway 70 serves to allow the flow of oil 22 to bypass the balls 64 and 66. The pressure release passageway 70 connects the middle of the reservoir segment 54 to the large-diameter chamber 62. The pressure release passageway 70 extends around the pump cylinder segment 58.

A helically threaded port 72 is provided in base plate 24 for access to the pressure release passageway 70. A thumbscrew 74 is screwed into the port 72 and projects into the pressure release passageway 70 to limit flow therein. When fully screwed into the port 72, the thumbscrew 74 fully blocks flow through the pressure release passageway 70. When unscrewed, oil 22 freely flows from the main cylinder 26 to the reservoir 20 when a downward force is applied to the top of the main piston 30 so as to return the main piston 30 to its retracted position within the main cylinder 26.

Operating the bottle jack 12 is straightforward. First, with the main piston 30 in a fully retracted position within the main cylinder 26, the thumbscrew 74 is fully tightened to ensure that the pressure release passageway 70 is closed. Then, the lever arm 40 is elevated to create a partial vacuum (capable of drawing oil 22 from the reservoir 20 into the pump cylinder 34) in the pump cylinder 34. Next, the lever arm 40 is given a down stroke to push pressurized oil 22 from the pump cylinder 34 into the main cylinder 26. As the oil 22 enters the main cylinder 26, the main piston 30 is driven outwardly from the opening 28 of the main cylinder 26. Repeated stroking of the lever arm 40, elevates the main piston 30 to a desired height.

As the lever arm 40 is moved up and down, the balls 64 and 66 unseat from their resting positions in the chambers 60 and 62. On the upstroke, the small-diameter ball 64 unseats to allow oil 22 to flow into the pump cylinder 34 while the large-diameter ball 66 remains seated and the chamber 62 is closed to the flow of oil 22. On the down stroke of the lever arm 40, however, the small-diameter ball 64 seats against the end of the chamber 60 once again under the influence of the engaged spring 68 and the large-diameter ball 66 unseats so as to permit the oil 22 to flow to the main cylinder 26.

The piston 30 remains in a position extended from the main cylinder 26 when pumping of the lever arm 40 is stopped since the oil 22 in incompressible. When it is desired that the piston 30 be retracted, the thumbscrew 74 is unscrewed a few turns thereby permitting the oil 22 to return to the reservoir 20 through the pressure release passageway 70. Under load, the piston 30 retracts fully and permits the post ram 10 to be immediately reused.

The socket member 14 is an open-bottomed box with a square cross section. As such, socket member 14 has a top that is defined by the base plate 24 which has a square outline. Opposed front and back walls 78 and 80 are affixed to, and project downwardly from, the front and back of the top wall 76. A pair of opposed side walls 82 is affixed to, and projects downwardly from, the opposed sides of the top wall 76. The opposed side walls 82 also are affixed along their respective lengths to the front and back walls 78 and 80. Walls 76-82 are formed of sheet metal having a heavy gauge.

The socket member 14 is sized to receive one end of the 4×4 wooden post 16 therein. To this end, the opening 84 in the bottom of the socket member 14 measures about 3.5 inches by 3.5 inches (8.9 cm×8.9 cm). Since the walls 78-82 are about 6 inches (15.2 cm) long, the post 16 can be inserted to a depth of about 6 inches (15.2 cm) into the socket member 14.

A helically threaded aperture 86 is provided in the center of the front wall 78. A helically threaded sleeve 88 is affixed to the front wall 78 so as to surround and reinforce the aperture 86. A thumbscrew 90 is screwed into the aperture 86 and sleeve 88 so as to project through the aperture 86 and into the post 16 positioned within the socket member 14 thereby locking the post ram 10 and post 16 together. By unscrewing the thumbscrew 90, however, the post 16 is selectively released from the socket member 14.

A lever arm retaining bar 92 is affixed to a side wall 82. The bar 92 has a length sufficient to reach the inner segment 42 of the lever arm 40 when the lever arm 40 is positioned horizontally. A locking pin 94 is extended through axially aligned bores 96 and 98 respectively provided in the bar 92 and the inner segment 42 to selectively lock the lever arm 40 in a position where the outer segment 44 can serve as a convenient carrying handle for the post ram 10. When the pin 94 is pulled from the bores 96 and 98, the lever arm 40 can be reciprocated to drive the main piston 30 from the main cylinder 26.

Figure 3:
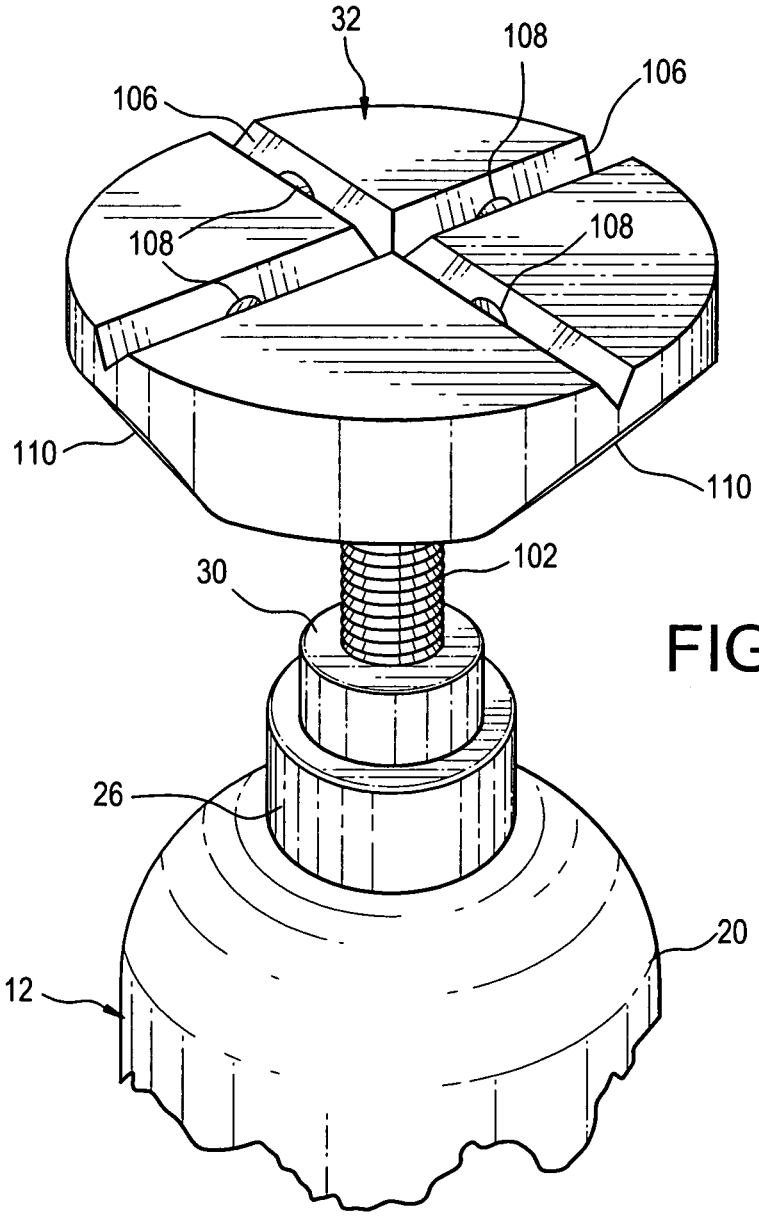
FIG. 3 is a perspective view of the load-bearing plate and the top of the bottle jack.

With particular reference to FIGS. 1 and 3, details of the piston 30 and the load-bearing plate 32 can be seen. As shown, piston 30 is provided with a helically threaded socket 100 that extends downward from the top thereof. Rotatably fitted within the socket 100 is an externally, helically threaded rod 102. Affixed atop the rod 102 is the load-bearing plate 32. By rotating the rod 102 within the socket 100, the load-bearing plate 32 can be selectively extended from the piston 30 or retracted toward the piston 30. Thus, the length of the temporary support 18 can be finely adjusted.

The load-bearing plate 32 is provided with optional features that facilitate its attachment to a wooden member like the joist shown at 104. In this regard, plate 32 has a pair of shallow, V-shaped notches 106 in its top and a pair of bores 108 that intersect each of the notches 106. The notches 106 intersect one another at right angles at the center of the plate 32. The bores 108, however, extend upwardly and inwardly from the bottom edge of the plate 32 to penetrate one of the notches 106 at a slight angle. The bottom edge of the plate 32 is provided with a beveled surface 110 around each of the bores 108. Each beveled surface 110 is flat and oriented at right angles to its associated bore 108.

A penetrating fastener such as the screw 112 can be positioned in the bores 108. The threaded shaft 114 of the screw 112 extends through a bores 108 and into the joist 104. The head 116 of the screw 112, being affixed to the threaded shaft 114 fits flush against a beveled surface 110. The inclination of the bores 108, of course, facilitates the engagement of a screwdriver (not shown) with the screw head 116.

The use of the post ram 10 is straightforward. First, a temporary support 18 is constructed by inserting a post 16 of suitable length into the socket member 14 and locking the post 16 in the socket member 14 by tightening the thumbscrew 90. Then, the temporary support 18 is oriented vertically such that the bottom of the post 16 is resting on, say, a basement floor and the load-bearing plate 32 engages the bottom of a sagging joist forming part of the first floor of a house. Next, the locking pin 94 is disengaged from the lever arm 40, and the lever arm 40 is manually pumped up and down to extend the main piston 30 and plate 32.

Continued pumping of the lever arm 40 causes the post ram 10, and the temporary support 18 made therefrom, to lengthen. The movement of the main piston 30 from the main cylinder 26 applies enough force to a building member, like a sagging floor joist, to straighten and level it. The force can be applied for as long as may be desired, days or even weeks.

While the temporary support 18 is in place, repair or reconstruction of a building is undertaken. (For example, a sagging joist is buttressed, reinforced, or replaced.) When the work is complete, the pin 94 is inserted back into the lever arm 40 to lock the outer segment 44 parallel to the side wall 78 thereby forming a solid handhold at one end of the support 18. Then, the thumbscrew 74 is loosened to allow the main piston 30 to retract into the main cylinder 26. The retraction of the main piston 30 disengages the plate 32 from the supported building member. Finally, the support 18 is moved to a desired location with the outer segment 44 serving as a convenient handle. If desired, the thumbscrew 90 is unscrewed and the post ram 10 is removed from the post 16. The post ram 10 now is stored in a toolbox or other convenient spot for immediate reuse.

The process of putting the post ram 10 to use as part of a temporary support 18 for a building structure requires one person only a few minutes to complete. Provided that the post 16 is supplied at a suitable length for use in the support 18, so that no sawing is required, no additional tools are needed to use the post ram 10. Use of the post ram 10, causes no damage to either the post 16 of the building structure supported thereby.

While the post ram 10 has been described with a high degree of particularity, it will be appreciated by those skilled in the field that modifications can be made to it. Therefore, it is to be understood that the present invention is not limited solely to the post ram 10, but encompasses any and all rams within the scope of the following claims.

I claim:

1. A post ram, comprising:

a socket member being configured to receive one end of a wooden post therein;

threaded member being threadably engaged with, and penetrating, said socket member for selectively securing the wooden post within said socket member, such that said threaded member extends into an interior of said socket member;

a hydraulic jack being affixed atop said socket member;

a lever arm operatively connected to the hydraulic jack;

a lever arm retaining member extending from said socket member; and a locking element penetrating said lever arm retaining member and said lever arm for selectively locking said lever arm in place, such that said lever arm is fixed relative to said hydraulic jack.

2. The post ram according to claim 1 wherein said socket member has a square cross section.

3. The post ram according to claim 1 further comprising a helically threaded sleeve being affixed to said socket member and said threaded member being threadably engaged with said helically threaded sleeve.

4. The post ram according to claim 1 wherein said lever arm is L-shaped having an inner segment being joined to an outer segment at a right angle, and said outer segment being oriented parallel to a longitudinal axis of said socket member when said hydraulic jack is in a storage configuration.

5. The post ram according to claim 1 wherein said hydraulic jack includes a movable piston and a load-bearing plate affixed thereto by means of a threaded rod, and said load-bearing plate being provided with at least one V-shaped notch in the top thereof for receiving an edge of a wooden building member.

6. The post ram according to claim 1 wherein said hydraulic jack includes a movable piston and a load-bearing plate affixed thereto, and said load-bearing plate being provided with at least one bore for the passage of a penetrating fastener connecting the post ram to a wooden building member.

7. The post ram according to claim 1 wherein said hydraulic jack includes a movable piston and a load-bearing plate affixed thereto, and said load-bearing plate being provided with a V-shaped notch in the top thereof for receiving a edge of a wooden building member, and said load-bearing plate also being provided with a bore intersecting said V-shaped notch for the passage of a penetrating fastener connecting the post ram to a wooden building member.

8. A temporary support, comprising:

a wooden post having opposed ends; and a post ram including:

a socket member within which one of said ends of said wooden post is inserted;

a threaded member being threadably engaged with, and penetrating, said socket member so as to selectively secure said wooden post within said socket member;

a hydraulic jack being affixed atop said socket member;

a lever arm operatively connected to the hydraulic jack;

a lever arm retaining member extending from said socket member; and a locking element penetrating said lever arm retaining member and said lever arm for selectively locking said lever arm in place, such that said lever arm is fixed relative to said hydraulic jack.

9. The post ram according to claim 1, wherein the hydraulic jack is a bottle jack.

10. The post ram according to claim 1, wherein the threaded member is a thumbscrew.

11. The post ram according to claim 1, further comprising means for (1) conveying hydraulic fluid to said hydraulic jack in response to actuation of said lever arm, and (2) conveying hydraulic fluid from said hydraulic jack in response to actuation of a pressure release member;

wherein said means is located within a top wall of said socket member.

12. A post ram, comprising:

a socket member being configured to receive one end of a wooden post therein;

a threaded member being threadably engaged with, and penetrating, said socket member for selectively securing the wooden post within said socket member, such that said threaded member extends into an interior of said socket member;

a hydraulic jack being affixed atop said socket member; and a lever arm operatively connected to the hydraulic jack;

wherein said socket member includes fluid passages and a valve that are in fluid communication with said hydraulic jack.

* * * * *